US011141840B2

(12) United States Patent
Timms

(10) Patent No.: US 11,141,840 B2
(45) Date of Patent: Oct. 12, 2021

(54) UNIVERSAL TUB DRAIN WRENCH

(71) Applicant: Robert Earl Timms, Buchanan, GA (US)

(72) Inventor: Robert Earl Timms, Buchanan, GA (US)

( * ) Notice: Subject to any disclaimer, the term of this patent is extended or adjusted under 35 U.S.C. 154(b) by 215 days.

(21) Appl. No.: 16/041,755

(22) Filed: Jul. 21, 2018

(65) Prior Publication Data

US 2020/0023499 A1 Jan. 23, 2020

(51) Int. Cl.
*B25B 13/54* (2006.01)
*B25B 23/16* (2006.01)

(52) U.S. Cl.
CPC ..... *B25B 13/54* (2013.01); *B25B 23/16* (2013.01)

(58) Field of Classification Search
CPC ..... B25B 13/54; B25B 23/16
USPC ..... 81/461
See application file for complete search history.

(56) References Cited

U.S. PATENT DOCUMENTS 2,627,773 A * 2/1953 Barnett ..... B25B 13/54 81/446
2,956,461 A * 10/1960 Anderson ..... B25B 13/48 81/438
5,172,615 A 12/1992 Albrecht
5,622,091 A * 4/1997 Crook ..... B25B 13/48 81/441
6,282,999 B1 * 9/2001 Hite ..... B25B 13/48 411/55
6,343,411 B1 * 2/2002 Sigman ..... B25B 13/44 29/263
6,675,679 B2 * 1/2004 Dugan ..... B25B 13/5083 81/442
7,024,972 B2 * 4/2006 Werner ..... B25B 13/48 81/442
2006/0016298 A1 * 1/2006 Chang ..... B25B 13/48 81/177.5
2010/0005932 A1 * 1/2010 Young ..... B25B 13/48 81/124.2

OTHER PUBLICATIONS

Rigid brand internal wrench, found online, Jul. 17, 2018, https://www.ridgid.com/US/en/internal-wrench.

* cited by examiner

*Primary Examiner* — Hadi Shakeri
(74) *Attorney, Agent, or Firm* — Crose Law LLC; Bradley D. Crose

(57) ABSTRACT

A tub drain wrench assembly, having a first assembly mode for use as a drain removal tool and second assembly mode for use as a drain installer, includes: a cam shaft, a hole to receive a lever; a pair of cam followers, and a channel to receive the cam shaft; an elastomeric ring configured for placement around the cam followers; and a reinstall tool having a multiplicity of gripping forks and a channel to receive the cam shaft; a lever handle; wherein in the first assembly mode, the universal tub drain wrench comprises the cam followers, the cam shaft, the elastomeric ring, and the lever handle, and is configured for use as a tub drain removal tool; and wherein in the second assembly mode, the universal tub drain wrench comprises the cam shaft, the lever handle, and the reinstall tool, and is configured for use as a drain installer.

4 Claims, 7 Drawing Sheets

UNIVERSAL TUB DRAIN WRENCH

FIELD OF THE INVENTION

The technology described herein relates generally to plumbing tools. More specifically, this technology relates to a universal tub drain wrench for use in the removal of an existing tub drain and reconfigurable for use in the installation of a new tub drain. Furthermore, this technology relates to universal tub drain wrench that performs reinstallation without damage to the new tub drain.

BACKGROUND OF THE INVENTION

There are known in the background art a variety of different devices and systems to remove a tub drain such as internal wrenches or the like. However, there remain many shortcomings and deficiencies in the known background art. Known attempts to address these and related problems are enumerated below.

Related utility patents known in the art include the following:

U.S. Pat. No. 5,172,615, issued to Albrecht on Dec. 22, 1992, discloses an internal wrench.

Related non-patent literature known in the art include the following:

Rigid brand internal wrench, found online, Jul. 17, 2018, located at ridgid.com.

As should be apparent to one of ordinary skill in the art, upon reading this disclosure, these many known attempts to address such problems tub drains, and so forth, include many shortcomings and deficiencies.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

BRIEF SUMMARY OF THE INVENTION

In various exemplary embodiments, the technology described herein provides a tub drain removal tool, a new tub drain installation tool, and a universal tub drain wrench assembly.

In one exemplary embodiment, the technology described herein provides a universal tub drain wrench assembly. The universal tub drain wrench assembly includes a first assembly mode for use as a tub drain removal tool and a second assembly mode for use as a new drain installer, the wrench assembly comprising: a cam shaft; a hole disposed in the cam shaft to receive a lever to pass through; a pair of cam followers; a channel disposed in each of the pair of cam followers to receive the cam shaft to pass through both cam followers; an elastomeric ring configured for placement around the pair of cam followers; a reinstall tool having a channel to receive the cam shaft to pass through; and a lever handle, having an elongated rod by which to grip.

In the first assembly mode, the universal tub drain wrench comprises the cam followers, the cam shaft, the elastomeric ring to hold the cam followers together, and the lever handle, and is configured for use as a tub drain removal tool.

In the second assembly mode, the universal tub drain wrench comprises the cam shaft, the lever handle, and the reinstall tool, and is configured for use as a new drain installer.

In at least one embodiment of the universal tub drain wrench assembly, the cam shaft further comprises a pair of curved sides opposite one another, and a pair of flat sides opposite one another, the sides alternating.

In at least one embodiment of the universal tub drain wrench assembly, the hole further comprises a hole disposed in the cam shaft from one flat side through the cam shaft to the other flat side to receive a lever to pass through.

In at least one embodiment of the universal tub drain wrench assembly, the pair of cam followers further comprises a pair of cam followers having a first knurled edge, a second knurled edge, and a channel to receive the cam shaft to pass through both cam followers.

In at least one embodiment of the universal tub drain wrench assembly, the elastomeric ring further comprises an elastomeric ring having an inner edge and an outer edge and configured for placement around the pair of cam followers.

In at least one embodiment of the universal tub drain wrench assembly, the reinstall tool further comprises a reinstall tool having a multiplicity of gripping forks.

In at least one embodiment of the universal tub drain wrench assembly, the level handle further comprises a cylindrical metal rod.

In at least one embodiment of the universal tub drain wrench assembly, the level handle further comprises an end of the rod being slightly flattened.

In another exemplary embodiment, the technology described herein provides a tub drain removal tool. The tub drain removal tool comprises: a cam shaft; a hole disposed in the cam shaft to receive a lever to pass through; a pair of cam followers; a channel disposed in each of the pair of cam followers to receive the cam shaft to pass through both cam followers; an elastomeric ring configured for placement around the pair of cam followers; and a lever handle, having an elongated rod by which to grip. The tub drain removal tool comprises the cam followers, the cam shaft, the elastomeric ring to hold the cam followers together, and the lever handle, and is configured for use as a tub drain removal tool.

In at least one embodiment of the tub drain removal tool, the cam shaft further comprises a pair of curved sides opposite one another, and a pair of flat sides opposite one another, the sides alternating.

In at least one embodiment of the tub drain removal tool, the hole further comprises a hole disposed in the cam shaft from one flat side through the cam shaft to the other flat side to receive a lever to pass through.

In at least one embodiment of the tub drain removal tool, the pair of cam followers further comprises a pair of cam followers having a first knurled edge, a second knurled edge, and a channel to receive the cam shaft to pass through both cam followers.

In at least one embodiment of the tub drain removal tool, the elastomeric ring further comprises an elastomeric ring having an inner edge and an outer edge and configured for placement around the pair of cam followers.

In at least one embodiment of the tub drain removal tool, the level handle further comprises a cylindrical metal rod.

In at least one embodiment of the tub drain removal tool, the level handle further comprises an end of the rod being slightly flattened.

In yet another exemplary embodiment, the technology described herein provides a new tub drain installation tool.

The new tub drain installation tool includes: a cam shaft; a hole disposed in the cam shaft to receive a lever to pass through; a reinstall tool having a multiplicity of gripping forks and a channel to receive the cam shaft to pass through; and a lever handle, having an elongated rod by which to grip. The new tub drain installation tool comprises the cam shaft, the lever handle, and the reinstall tool, and is configured for use as a new tub drain installer.

In at least one embodiment of the new tub drain installation tool, the cam shaft further comprises a pair of curved sides opposite one another, and a pair of flat sides opposite one another, the sides alternating.

In at least one embodiment of the new tub drain installation tool, the hole further comprises a hole disposed in the cam shaft from one flat side through the cam shaft to the other flat side to receive a lever to pass through.

In at least one embodiment of the new tub drain installation tool, the reinstall tool further comprises a reinstall tool having a multiplicity of gripping forks.

In at least one embodiment of the new tub drain installation tool, the level handle further comprises a cylindrical metal rod.

In at least one embodiment of the new tub drain installation tool, the level handle further comprises an end of the rod being slightly flattened.

Advantageously, the technology described herein provides a tub drain removal tool and a universal tub drain wrench assembly that provides for the removal of an old tub drains, regardless of size, and even those with broken cross members inside the drain body. Also, advantageously, the technology described herein provides a new tub drain installation tool and a universal tub drain wrench assembly for installation of a new tub drain without causing damage to the tub drain. Further advantageously, the technology described herein provides a universal tub drain wrench assembly that includes a reconfigurable assembly for use as both a tub drain removal tool and a new tub drain installation tool.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

In various exemplary embodiments, the technology described herein provides a tub drain removal tool, a new tub drain installation tool, and a universal tub drain wrench assembly, separately and collectively.

Existing tools for the removal of tub drains lack the ability to remove tub drains of multiple sizes. Additionally, existing tools for the removal of tub drains lack the ability to remove tub drains having broken cross members inside the drain body. Furthermore, existing tools for the removal of tub drains cannot also install a new drain body without causing damage to the existing tub and drain.

The universal tub drain wrench assembly includes a first assembly mode for use as a tub drain removal tool. The universal tub drain wrench assembly includes a second assembly mode for use as a new drain installer.

Figure 6B:
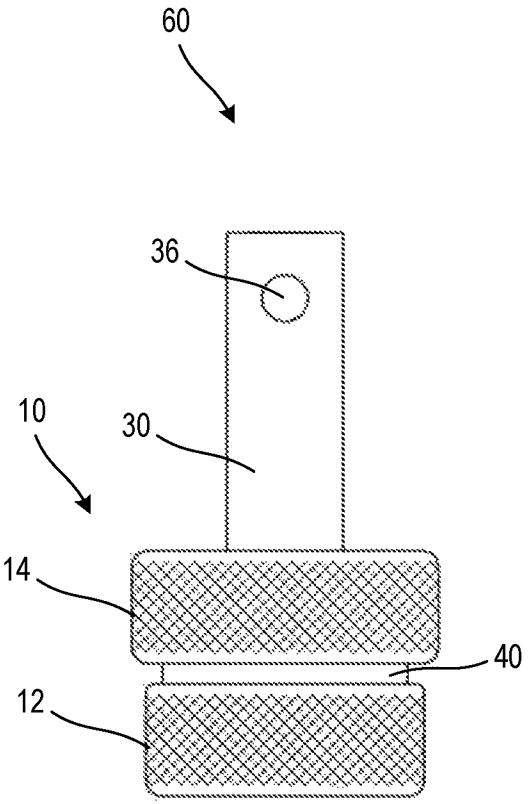
FIG. 6B is a side planar view of the universal tub drain wrench depicted in FIG. 6A, and illustrated without the lever handle in place.
Figure 6A:
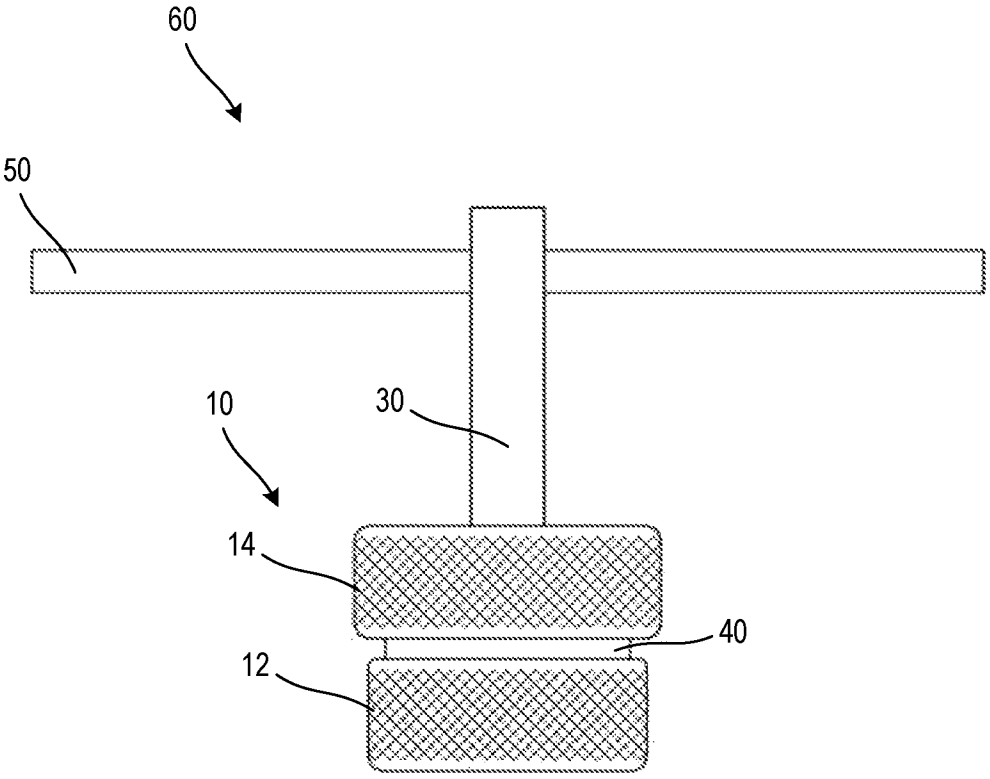
FIG. 6A is a front planar view of a universal tub drain wrench, shown in the assembly mode for removal of a tub drain, illustrating, in particular, the cam followers, the cam shaft, the elastomeric ring to hold the cam followers together, and the lever handle, according to an embodiment of the technology described herein.
Figure 7B:
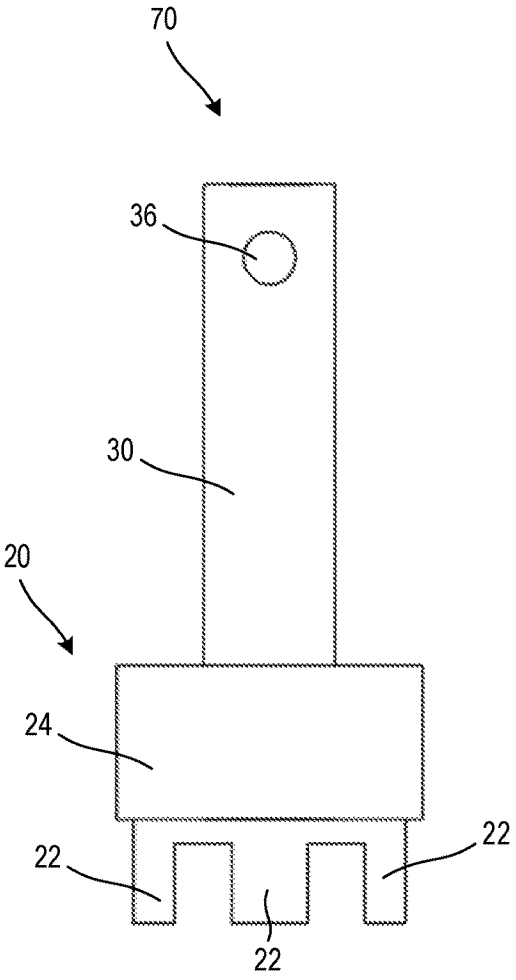
FIG. 7B is a side planar view of the universal tub drain wrench depicted in FIG. 7A, and illustrated without the lever handle in place.
Figure 7A:
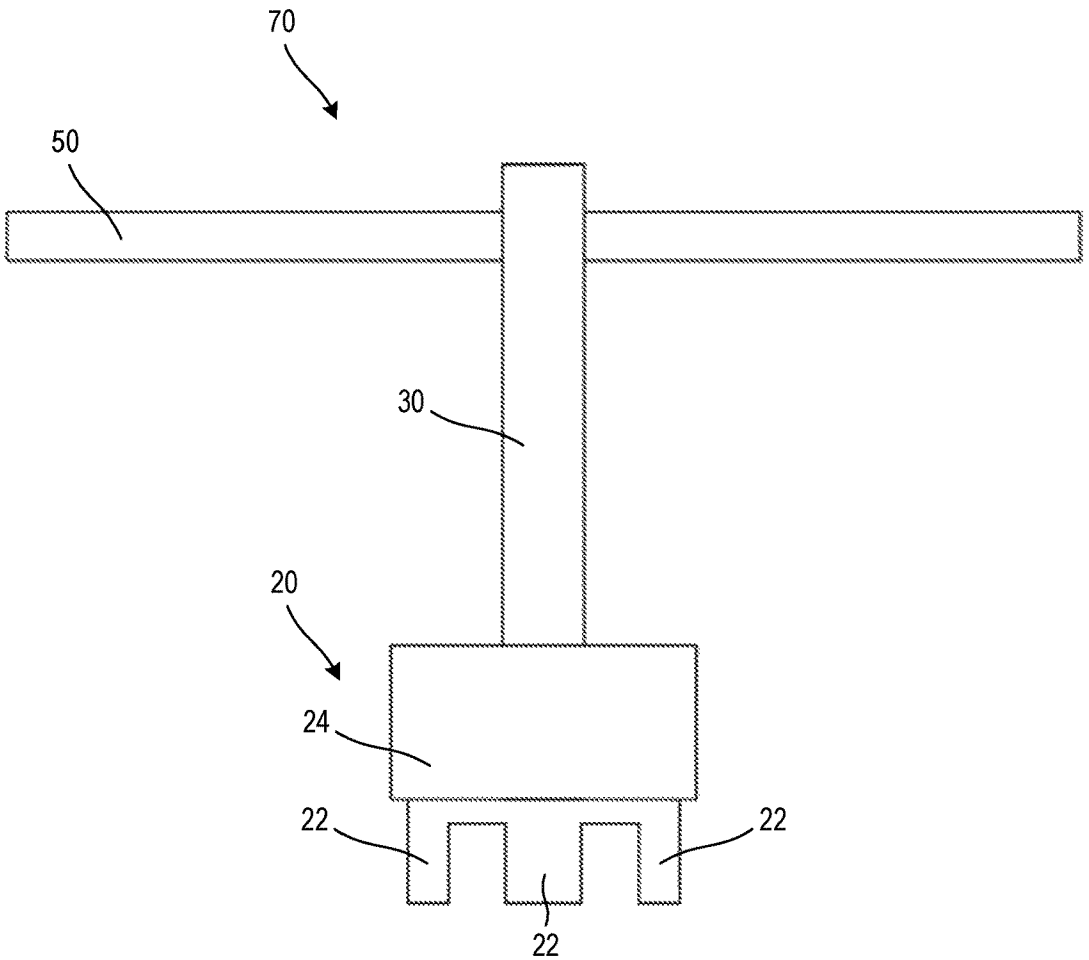
FIG. 7A is a is a front planar view of a universal tub drain wrench, shown in the assembly mode for installation of a tub drain, illustrating, in particular, the cam shaft, the lever handle, and the reinstall tool, according to an embodiment of the technology described herein.

Referring now to the Figures, a universal tub drain wrench assembly is shown. The universal tub drain wrench assembly is shown, for example, in a first assembly mode 60 configured for removal of an existing tub drain. (Depicted in FIG. 6). The universal tub drain wrench assembly is shown, for example, in a second assembly mode 70 configured for installation of a new tub drain. (Depicted in FIG. 7).

Referring now to FIG. 1A through FIG. 1D, the universal tub drain wrench assembly includes a cam follower assembly 10 such as a pair of cam followers 12, 14. The pair of cam followers 12, 14 includes a widest knurled edge, such as 14, and a narrowest knurled edge, such as 12. These knurled edges on the pair of cam followers 12, 14 provide a means by which to strongly grip internally the inner portions of the tub drain for removal.

The cam follower assembly 10 includes a channel 16 through each of the pair of cam followers 12, 14. The channel 16 is configured to receive a cam shaft to pass through the pair of cam followers 12, 14.

By way of example and not of limitation, the cam follower can include a diameter of 1.64" at the widest knurled edge 14 and a diameter of 1.31" at the narrowest knurled edge 12.

By way of example and not of limitation, the channel 16 diameter for the cam shaft to pass through has a width of 0.38" and a length of 0.70".

Referring now to FIG. 2A through FIG. 2D, the universal tub drain wrench assembly includes a reinstall tool 20. The reinstall tool 20 is used with the universal tub drain wrench assembly to install a new tub drain assembly. The reinstall tool 20 includes a channel 26 to receive the cam shaft to pass through.

The reinstall tool 20 includes a multiplicity of gripping forks 22. The gripping forks 22 are disposed upon a base 24 for installation of a new tub drain into a tub.

By way of example and not of limitation, the reinstall tool 20 includes a diameter of 1.45" and includes an overall length of 1.22".

By way of example and not of limitation, the multiplicity of gripping forks 22 are 0.38" in length and are 0.36" in width and have a thickness of 0.16".

By way of example and not of limitation, the channel 26 in the reinstall tool 20 for the cam shaft to pass through is 0.52" in length and 0.63" in length at its widest point and the straight parallel sides are 0.41" apart.

Referring now to FIG. 3A through 3D, the universal tub drain wrench assembly includes a cam shaft assembly 30. The cam shaft assembly 30 can include a pair of curved sides 32 opposite one another, and a pair of flat sides 34 opposite one another, the sides alternating.

By way of example and not of limitation, the cam shaft is 3.26" in length and has a width of 0.87" at its widest point. The cam shaft on the curved sides includes a diameter of 0.62". The cam shaft on the flat side of 0.39". The width of the flat side is 0.50".

The cam shaft assembly 30 includes a hole 36. The hole 36 is disposed in the cam shaft from one flat side through the cam shaft to the other flat side to receive a lever to pass through.

By way of example and not of limitation, the hole 36 has a diameter of 0.25" at the top of the cam shaft for the lever to pass through. The hole 36 is located on the flat side 0.35" from the top to the center of the hole 36.

Figure 1A:
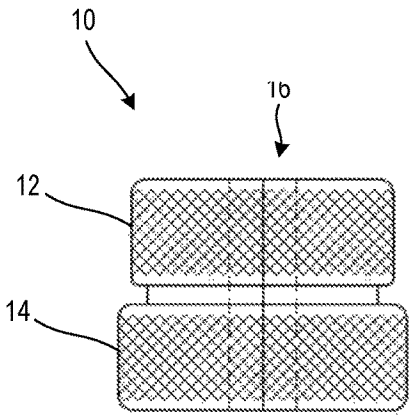
FIG. 1A is a front planar view of a pair of cam followers, a component of the tub drain wrench, illustrating, in particular, a widest knurled edge, a narrowest knurled edge, and a channel to receive a cam shaft to pass through, according to an embodiment of the technology described herein.
Figure 1B:
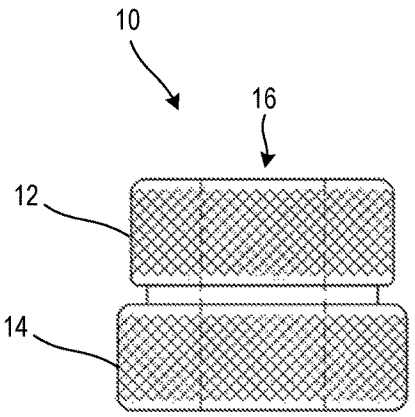
FIG. 1B is a side planar view of the cam followers depicted in FIG. 1A.
Figure 1C:
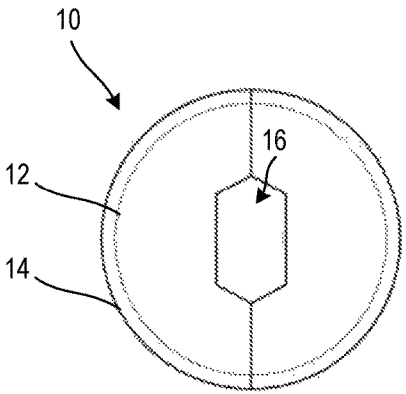
FIG. 1C is top planar view of the cam followers depicted in FIG. 1A.
Figure 1D:
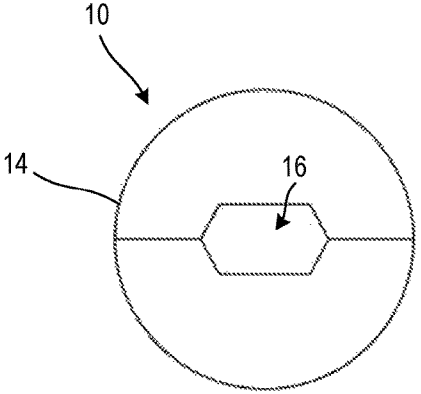
FIG. 1D is bottom planar view of the cam followers depicted in FIG. 1A.
Figure 2A:
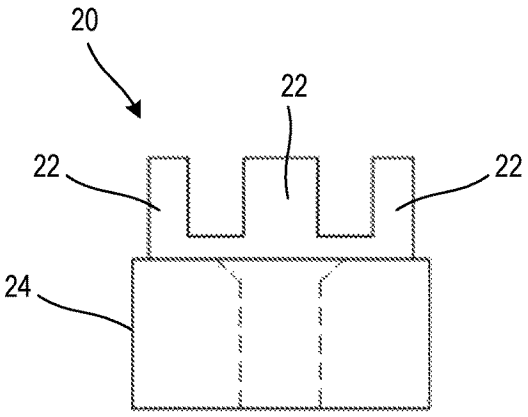
FIG. 2A is a front planar view of a reinstall tool, a component of the tub drain wrench used as a drain installer, illustrating, in particular, a multiplicity of gripping forks and a channel to receive a cam shaft to pass through, according to an embodiment of the technology described herein.
Figure 2B:
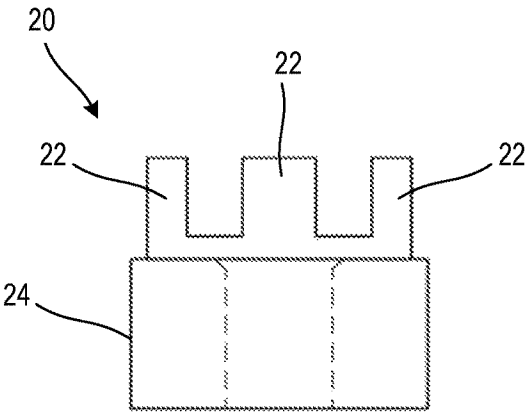
FIG. 2B is a side planar view of the reinstall tool depicted in FIG. 2A.
Figure 2C:
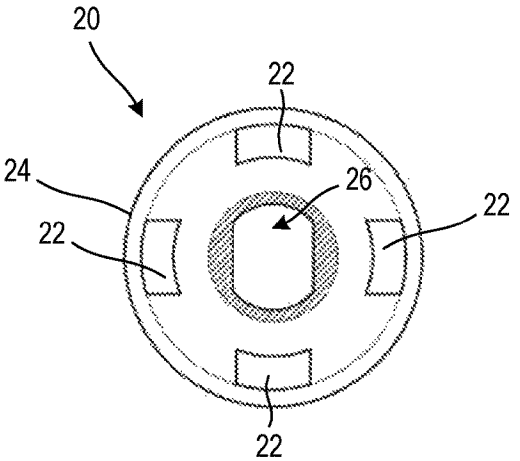
FIG. 2C is a top planar view of the reinstall tool depicted in FIG. 2A.
Figure 2D:
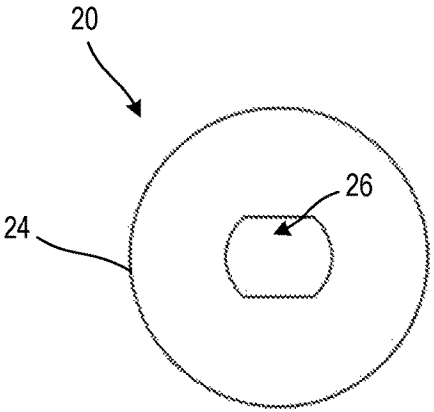
FIG. 2D is a bottom planar view of the reinstall tool depicted in FIG. 2A.
Figure 3A:
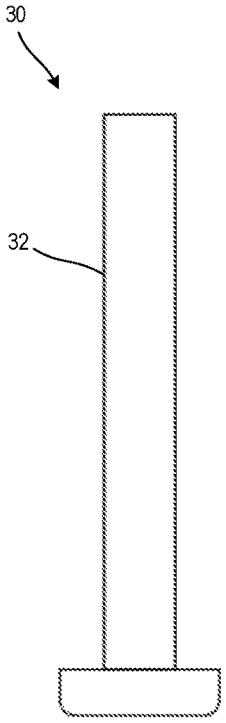
FIG. 3A is a front planar view of a cam shaft, a component of the tub drain wrench used for both removal and installation, illustrating, in particular, a pair of curved sides opposite one another, and a pair of flat sides opposite one another, the sides alternating, and a hole disposed from one flat side through the cam shaft to the other flat side to receive a lever to pass through, according to an embodiment of the technology described herein.
Figure 3B:
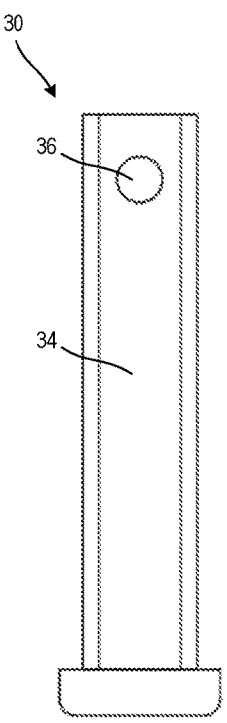
FIG. 3B is a side planar view of the cam shaft depicted in FIG. 3A.
Figure 3C:
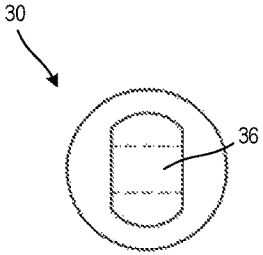
FIG. 3C is a top planar view of the cam shaft depicted in FIG. 3A.
Figure 3D:
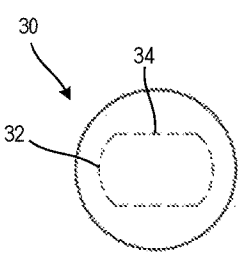
FIG. 3D is a bottom planar view of the cam shaft depicted in FIG. 3A.
Figure 4:
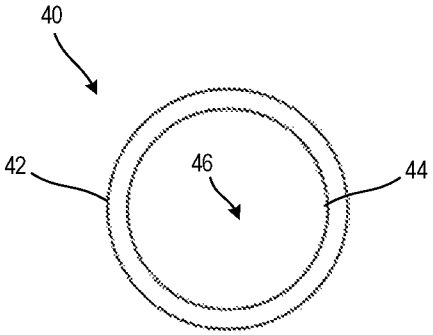
FIG. 4 is a top planar view of an elastomeric ring, a component of the tub drain wrench used as a drain remover, illustrating, in particular, an inner edge and an outer edge, according to an embodiment of the technology described herein.

Referring now to FIG. 4, the universal tub drain wrench assembly includes an elastomeric ring 40. The elastomeric ring 40 is configured for placement around the pair of cam followers 12, 14.

The elastomeric ring 40 includes an inner edge 44, an outer edge 42, and an interior cavity area 46, all configured for placement around the pair of cam followers 12, 14.

By way of example and not of limitation, the elastomeric ring 40 has a diameter of 1.21 inches.

Figure 5A:
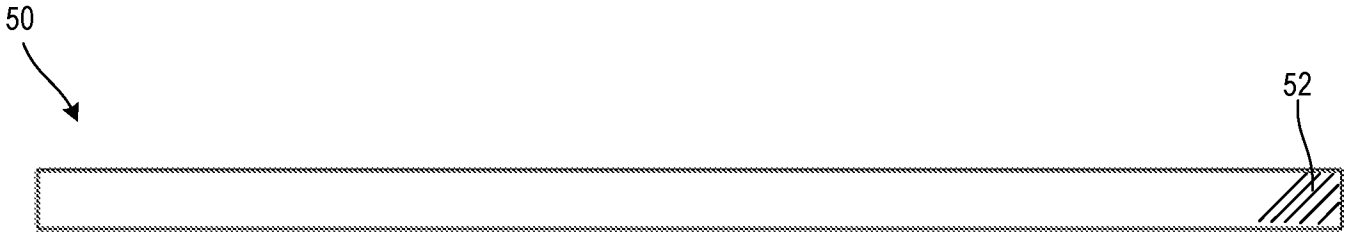
FIG. 5A is a top planar view of a lever handle, a component of the tub drain wrench used as a drain remover and a drain installer, illustrating, in particular, an elongated rod by which to grip and one end of the rod being slightly flattened, according to an embodiment of the technology described herein.
Figure 5B:
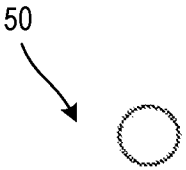
FIG. 5B is a side view of the lever handle depicted un FIG. 5A.

Referring now to FIG. 5A through 5B, the universal tub drain wrench assembly includes and a lever handle 50. The lever handle 50 is an elongated rod by which to grip.

In at least one embodiment of the universal tub drain wrench assembly, the level handle 50 further comprises an end 52 of the rod being slightly flattened.

By way of example and not of limitation, the rod 50 is 5.09" in length and has a 0.23" diameter.

In the first assembly mode, the universal tub drain wrench comprises the cam followers, the cam shaft, the elastomeric ring to hold the cam followers together, and the lever handle, and is configured for use as a tub drain removal tool.

In the second assembly mode, the universal tub drain wrench comprises the cam shaft, the lever handle, and the reinstall tool, and is configured for use as a new drain installer.

In operation the universal tub drain wrench removes the tub drain by gripping the internal wall of the drain. This is achieved by twisting the lever handle 50 of the cam shaft 30 which expands the cam followers 12, 14 thereby forcing them to externally expand and grip the interior wall of the drain with the knurled exterior of the cam followers 12, 14.

In operation the universal tub drain wrench installs a new drain by using the reinstall tool 20 installed on the cam shaft

30 with the gripping forks 22 facing downward. Turning the lever handle 50 then turns the cam shaft 30 forcing the gripping forks 22 to rotate, thereby to turn the drain.

Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

TABLE 1

| | |
|---|---|
| 10 | cam follower assembly |
| 12 | narrowest knurled edge |
| 14 | widest knurled edge |
| 16 | cam follower channel |
| 20 | reinstall tool |
| 22 | gripping fork |
| 24 | base |
| 26 | reinstall tool channel |
| 30 | cam shaft assembly |
| 32 | curved side |
| 34 | flat side |
| 36 | cam shaft hole |
| 40 | elastomeric ring |
| 42 | outer edge |
| 44 | inner edge |
| 46 | interior cavity area |
| 50 | lever handle (rod) |
| 52 | flattened end |
| 60 | first assembly mode for tub drain removal |
| 62 | second assembly mode for tub drain installation |

What is claimed is:

1. A universal tub drain wrench assembly, having a first assembly mode for use as a tub drain removal tool and a second assembly mode for use as a new drain installer, the wrench assembly comprising:

a cam shaft comprising an integrally formed non-detachable annular flange being disposed about a distal end thereof, wherein the cam shaft further comprises a pair of curved sides opposite one another, and a pair of flat sides opposite one another, the sides alternating; and wherein the cam shaft further comprises a hole disposed in the cam shaft from one flat side through the cam shaft to the other flat side about a proximal end opposite to said distal end, the hole disposed in the cam shaft to receive a lever handle to pass through;

a pair of cam followers having a first knurled edge on a first cam follower and a second knurled edge on a second cam follower, an annular groove formed between the pair of cam followers;

a channel disposed in each of the pair of cam followers to receive the proximal end of the cam shaft to pass through both cam followers;

an elastomeric ring configured for placement around the pair of cam followers within said annular groove to couple the pair of cam followers with the cam shaft;

a reinstall tool having a multiplicity of gripping forks to match a pattern of a tub drain and a channel to receive the proximal end of the cam shaft to pass through; and a lever handle, having an elongated rod by which to grip;

wherein in the first assembly mode, the universal tub drain wrench comprises the cam followers, the cam shaft, the elastomeric ring to hold the cam followers together, and the lever handle, and is configured for use as a tub drain removal tool; and wherein in the second assembly mode, the universal tub drain wrench comprises the cam shaft, the lever handle, and the reinstall tool, and is configured for use as a new drain installer.

2. The tub drain wrench assembly of claim 1, wherein the elastomeric ring further comprises an elastomeric ring having an inner edge and an outer edge and configured for placement around the pair of cam followers.

3. The tub drain wrench assembly of claim 1, wherein the level handle further comprises a cylindrical metal rod.

4. The tub drain wrench assembly of claim 1, wherein the level handle further comprises an end being slightly flattened.

* * * * *